US007296316B1

(12) United States Patent
Wu

(10) Patent No.: US 7,296,316 B1
(45) Date of Patent: Nov. 20, 2007

(54) MULTIPURPOSE TOOL DEVICE

(76) Inventor: Jung Chung Wu, No. 12, Lane 72, Gubao Street, Anping Dist., Tainan (TW) 70841

( * ) Notice: Subject to any disclaimer, the term of this patent is extended or adjusted under 35 U.S.C. 154(b) by 0 days.

(21) Appl. No.: 11/472,672

(22) Filed: Jun. 21, 2006

(51) Int. Cl.
*B26B 11/00* (2006.01)
*B26B 1/08* (2006.01)

(52) U.S. Cl. ..... 7/158; 7/160; 7/168; 30/162

(58) Field of Classification Search ..... 7/160, 7/165, 158, 167, 168; 30/162, 335, 336
See application file for complete search history.

(56) References Cited

U.S. PATENT DOCUMENTS 5,285,574 A * 2/1994 Feltner ..... 30/162
5,617,597 A 4/1997 Reitz ..... 7/113
5,638,566 A * 6/1997 Wu ..... 7/167
6,220,973 B1 4/2001 Hsu ..... 473/408
6,233,770 B1 * 5/2001 Garcia ..... 7/165

* cited by examiner

*Primary Examiner*—D. S. Meislin
(74) *Attorney, Agent, or Firm*—Charles E. Baxley

(57) ABSTRACT

A tool device includes a number of tool members and enclosing members selectively attachable to either of two ends of a housing, a tool element slidably received in the housing and movable out through the enclosing member, and a moving device attached to the tool element for moving the tool element into and out of the housing or the enclosing member. A follower is slidably received in the housing and coupled to the tool element, and a knob is coupled to the follower for moving the follower and the tool element relative to the housing. A positioning device may position the tool element to the housing. An additional tool device may be selectively attached to the housing.

17 Claims, 7 Drawing Sheets

MULTIPURPOSE TOOL DEVICE

BACKGROUND OF THE INVENTION

1. Field of the Invention

The present invention relates to a tool device, and more particularly to a multipurpose tool device including a number of tool members or tool elements selectively and changeably attached or coupled together for allowing the users to conduct various kinds of works.

2. Description of the Prior Art

Various kinds of typical multipurpose tool devices have been developed and comprise a number of tool members or tool elements selectively and changeably attached or coupled together for conducting various kinds of works and/or for providing different uses.

For example, U.S. Pat. No. 5,617,597 to Reitz discloses one of the typical multipurpose kitchen tools also comprising a number of tool members or tool elements pivotally or slidably or removeably disposed or attached to an outer housing and foldable or removable outward of the outer housing for conducting various kinds of kitchen works. However, the other tool members or tool elements may not be selectively and changeably attached or coupled to the outer housing.

U.S. Pat. No. 6,220,973 to Hsu discloses another typical multipurpose golf auxiliary tool also comprising a number of tool members or tool elements pivotally or slidably or removeably disposed or attached to an outer housing and foldable or removable outward of the outer housing for conducting various kinds of golf exercises. However, similarly, the other tool members or tool elements also may not be selectively and changeably attached or coupled to the outer housing.

The present invention has arisen to mitigate and/or obviate the afore-described disadvantages of the conventional multipurpose tool devices.

SUMMARY OF THE INVENTION

The primary objective of the present invention is to provide a tool device including a number of tool members or tool elements selectively and changeably attached or coupled together for conducting various kinds of works.

In accordance with one aspect of the invention, there is provided a tool device comprising a housing including a chamber formed therein, and including two end portions, at least one tool member selectively attachable to either of the end portions of the housing, at least one enclosing member selectively attachable to either of the end portions of the housing, and including a bore formed therein, at least one tool element slidably received in the chamber of the housing and slidable or movable out through the bore of the enclosing member, and a moving device attached and coupled to the tool element for moving the tool element relative to the housing and for selectively moving the tool element into and out of the bore of the enclosing member.

The moving device includes a follower slidably received in the housing and coupled to the tool element and moved in concert with the tool element. The housing includes a space formed therein and communicating with the chamber of the housing for slidably receiving the follower.

The moving device includes a knob coupled to the follower for moving the follower and the tool element relative to the housing. The housing includes a groove formed therein and communicating with the space of the housing, and the knob includes at least one pin extended therefrom and slidably engaged in the groove of the housing for engaging with the follower and for allowing the follower and the tool element to be moved relative to the housing with the knob.

The moving device includes a positioning device for positioning the tool element to the housing and having a spring biased catch attached to the knob and engaged with the housing for positioning the tool element to the housing. The spring biased catch is preferably engaged with the pin of the knob and retained or positioned between the knob and the follower.

The housing includes at least one notch formed therein and communicating with the groove of the housing for engaging with the spring biased catch and for positioning the spring biased catch to the housing. The moving device includes a spring ring member engaged with the pin of the knob and having the spring biased catch extended therefrom. The follower includes at least one aperture formed therein for receiving the pin of the knob and for attaching the knob to the follower.

The tool element includes an orifice formed therein, and the follower includes a peg extended therefrom for engaging with the orifice of the tool element and for attaching the follower to the tool element. The housing includes a longitudinal channel formed therein and communicating with the chamber of the housing for slidably receiving the tool element therein and for guiding the tool element to move relative to the housing.

An additional tool assembly is selectively attachable to the housing and includes a bar for attaching to the housing. The bar includes an opening formed therein, the tool member and the tool enclosing member each include a shank for engaging through the opening of the bar and for attaching or securing the bar to the housing.

The bar includes two end flaps extended therefrom, and at least one second tool element attached to either of the flaps of the bar. The flaps each include a cavity formed therein, and the second tool element includes an orifice formed therein for aligning with the cavity of the flaps and for receiving a fastening device which may pivotally or rotatably couple the second tool element to the flaps of the bar.

The flaps each include at least one depression formed therein and communicating with the cavity thereof, and the second tool element includes at least one projection extended therefrom for engaging into the depression of the flap and for positioning the second tool element at selected positions relative to the flaps of the bar.

The fastening device includes a stem engaged through the orifice of the second tool element and the cavity of the flap for pivotally coupling the second tool element to the flaps of the bar. The fastening device includes a peripheral slot formed in the stem for receiving a retaining ring member which may bias or force the projection of the second tool element to engage into the depression of the flap.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
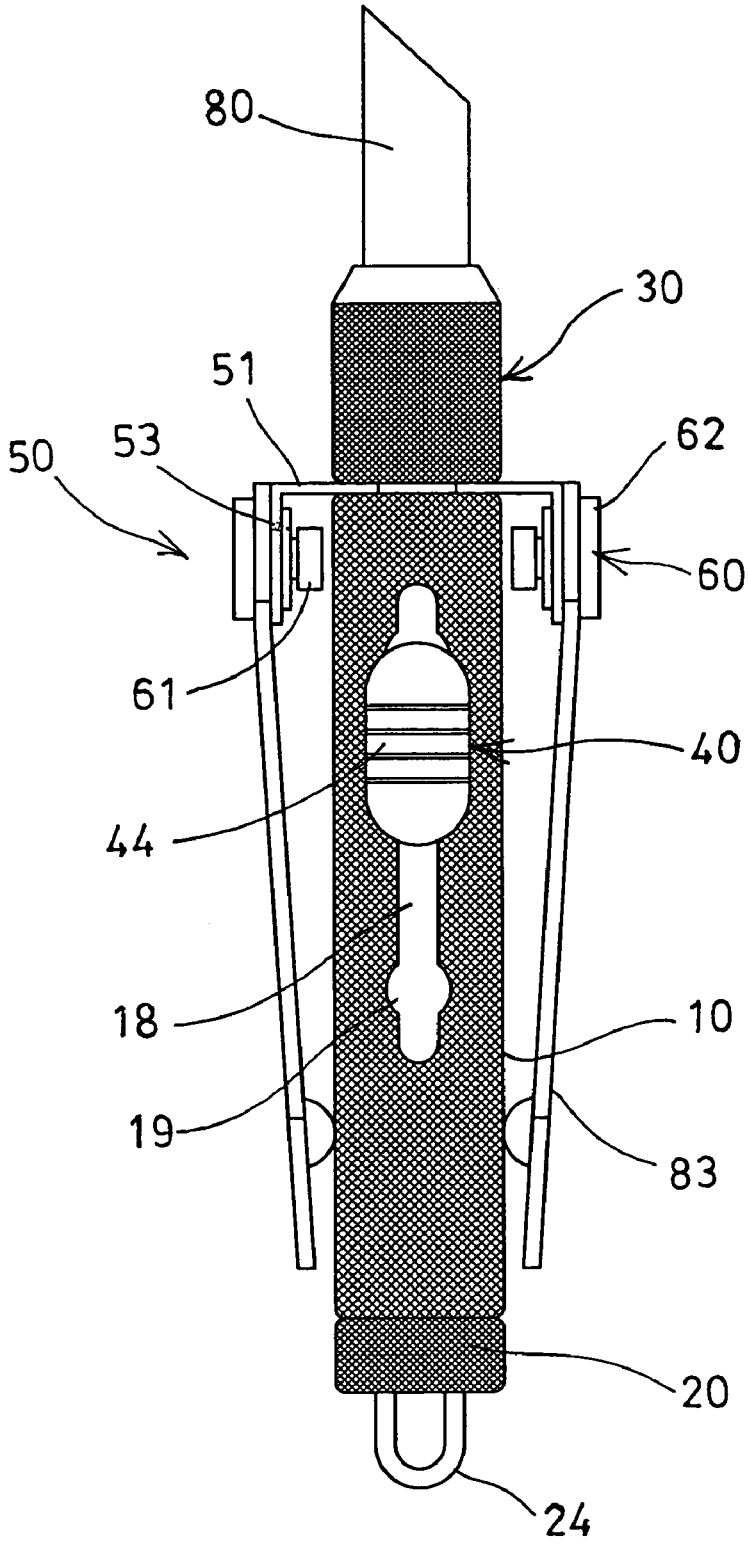
FIG. 1 is a plan schematic view of a tool device in accordance with the present invention.

Referring to the drawings, and initially to FIGS. 1-4, a tool device in accordance with the present invention comprises an outer housing 10 including a chamber 11 formed therein, and including two end portions 12, 13 each having an engaging device 14, such as an outer thread or an inner thread 14 formed therein for attaching or engaging or coupling the other housings 8 (FIGS. 15-17), or tool members 20 (FIGS. 1-2, 4-5, 7-8 and 11-12), or tool or enclosing members 30 (FIGS. 1-2, 4-5, 7-8, and 11-17). For example, the tool members 20 may be selected from an end cap 20 (FIGS. 1-2, 4-5, 7-8, 11-12 and 14), a laser tool 21 (FIG. 13), a pen 22 (FIGS. 15-17), or the like.

Figure 14:
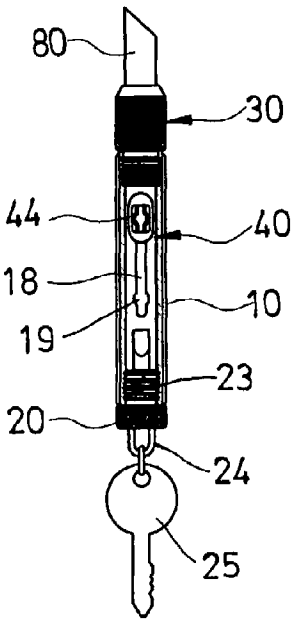
FIGS. 14, 15, 16, 17 are partial cross sectional views similar to FIGS. 4 and 5, illustrating the still further arrangements of the tool device.

The tool members 20, 21, 22 each include another engaging device 23, 31, such as an outer thread or threaded shank 23, 31 provided thereon for threading or engaging with the engaging devices 14 of the housing 10 and for selectively and changeably attaching or coupling to the housing 10, and/or for enclosing one end of the housing 10. The tool member 20 may include a loop or ring 24 attached or coupled thereto for attaching the other objects 25, such as keys 25 (FIG. 14). The enclosing members 30 each may include a bore 32 formed therein (FIG. 2) for receiving two gaskets or inserts 33 therein, in which the inserts 33 each preferably include a semi-cylindrical structure.

Figure 15:
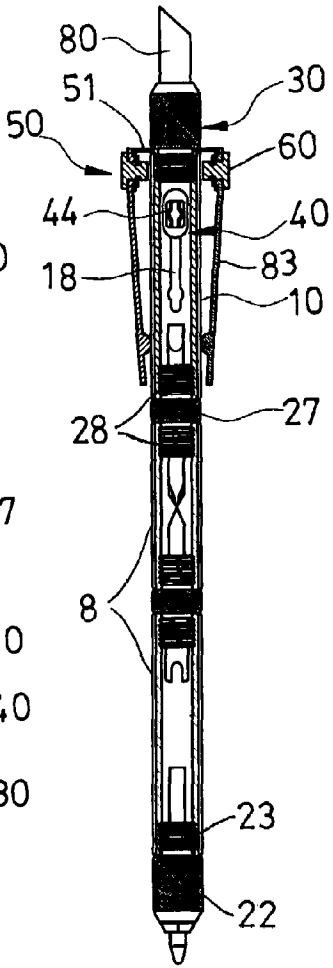
Figure 16:
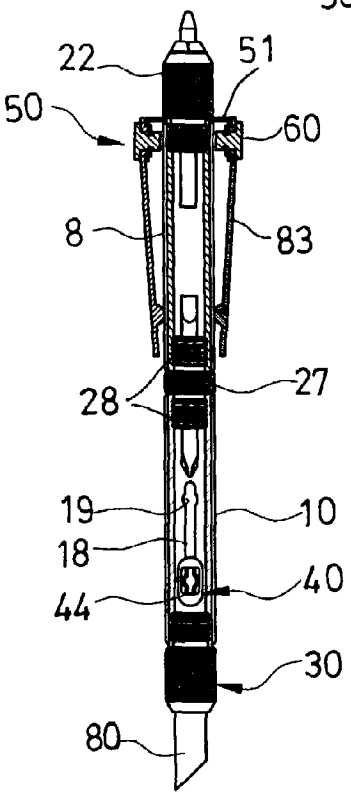
Figure 17:
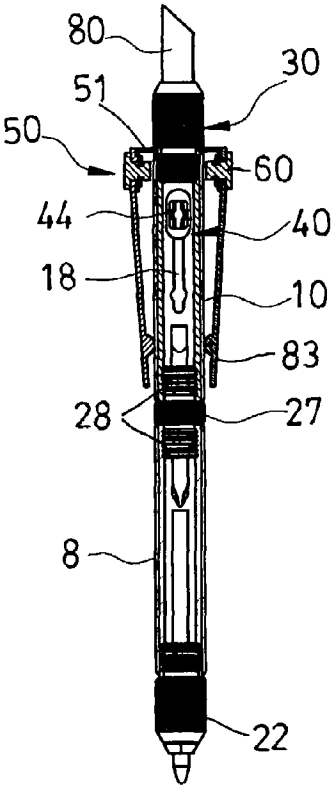

As shown in FIGS. 15-16, one (FIGS. 16-17) or more (FIG. 15) couplers 27 may further be provided and each include two outer threads or end threaded shanks 28 provided thereon for selectively and changeably threading or engaging with the engaging devices 14 of the housing 10 and thus for selectively and changeably attaching or coupling to the housing 10, and thus for selectively and changeably attaching or coupling the further housings 8 to the housing 10, and thus for allowing the housings 8, 10 to be selectively and changeably or adjustably coupled together to form various kinds of lengths.

Figure 4:
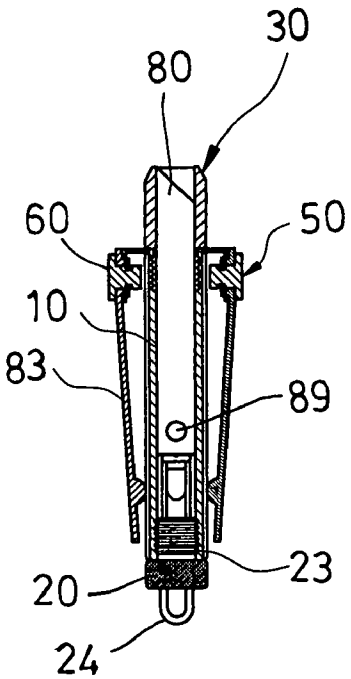
FIG. 4 is a partial cross sectional view of the tool device.
Figure 3:
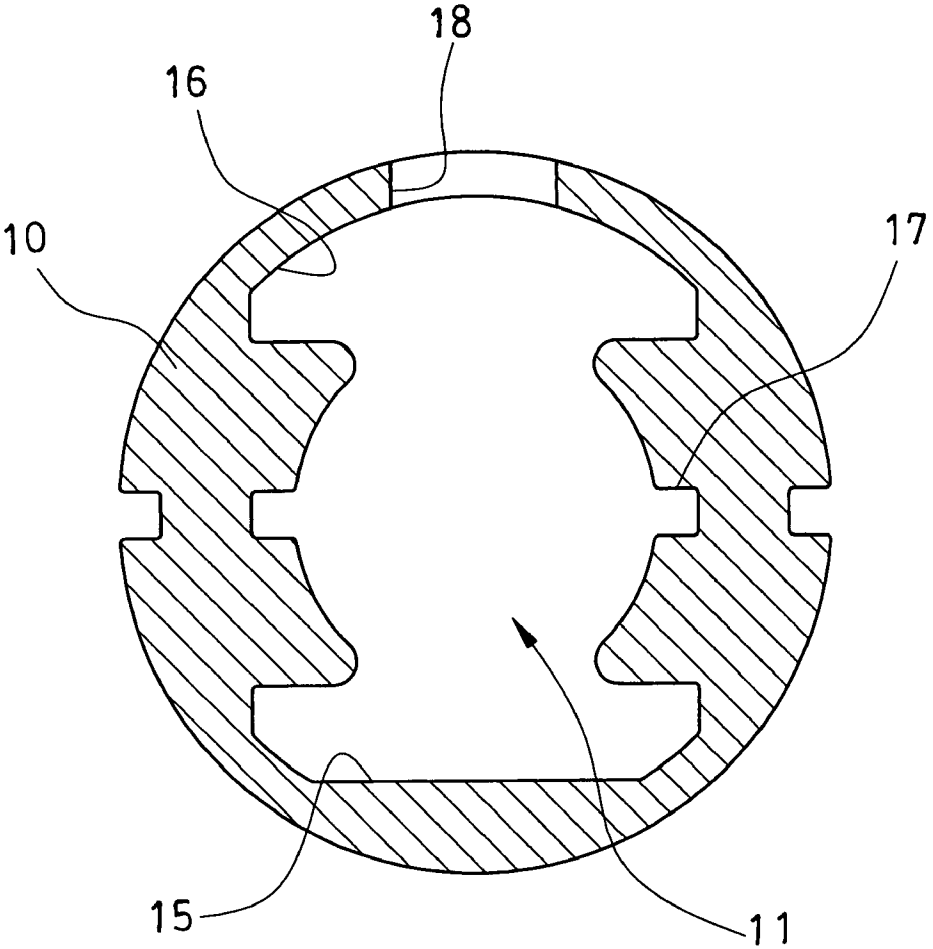
FIG. 3 is a cross sectional view illustrating an outer housing of the tool device, taken along lines 3-3 of FIG. 2.
Figure 8:
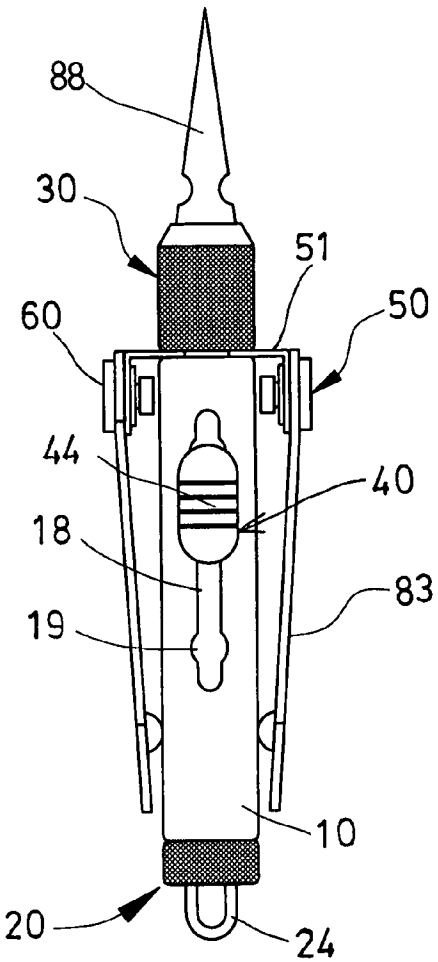
FIGS. 7, 8 are plan schematic views similar to FIG. 1, illustrating the other arrangement of the tool device.
Figure 7:
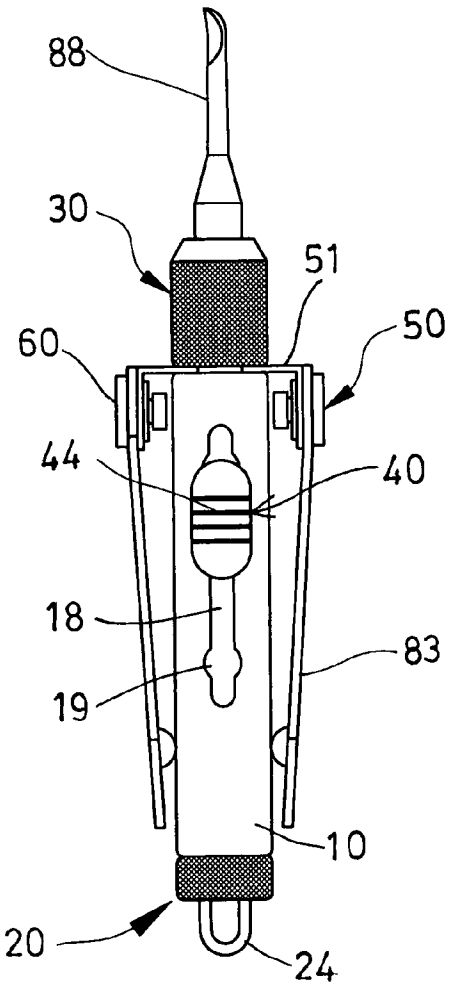
Figure 9:
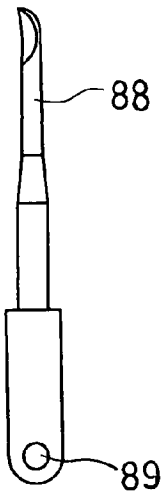

As shown in FIGS. 1 and 3-4, the housing 10 further includes one or more spaces 15, 16 formed therein, such as formed in opposite sides of the housing 10 and communicating with the chamber 11 of the housing 10, and further includes a longitudinal channel 17 formed therein, such as formed in the middle or center portion of the housing 10 and intersecting or communicating with the chamber 11 of the housing 10 (FIG. 3) for slidably receiving a tool element 80 therein, one or more further or spare tool elements 88 (FIGS. 7-10 and 13) may further be provided and changeably engaged into one of the spaces 15 of the housing 10 for selectively and changeably engaging into the channel 17 of the housing 10 (FIGS. 7-8).

It is preferable that the channel 17 of the housing 10 and the tool element 80 include a suitable mating width or thickness for snugly fitting the tool element 80 in the channel 17 of the housing 10 and for suitably guiding the tool element 80 to slide or move along the channel 17 of the housing 10 (FIGS. 4, 5) and for preventing the tool element 80 from being moved laterally or sidewise relative to the housing 10. The tool elements 80, 88 may also be suitably engaged between the inserts 33 which may further guide the tool elements 80, 88 to smoothly move into and out of the housing 10 and the bore 32 of the enclosing members 30, and each include an orifice 89 formed in one end thereof for coupling purposes.

The housing 10 further includes a groove 18 formed therein, such as formed in one side of the housing 10 and intersecting or communicating with the other space 16 and the chamber 11 of the housing 10 for allowing other space 16 and the chamber 11 of the housing 10 to be seen or reached from outside of the housing 10, and includes one or more notches 19 formed therein and communicating with the groove 18 of the housing 10. A pushing or moving means or device 40 includes a follower 41 slidably received or engaged in the other space 16 of the housing 10 and having a shape or configuration for suitably mating with or for snugly fitting in the other space 16 of the housing 10 and for guiding the follower 41 to smoothly slide or move along the other space 16 of the housing 10.

The follower 41 includes a peg 42 extended outwardly therefrom (FIG. 2) for engaging into or with the orifice 89 of the tool elements 80, 88 and for attaching or coupling the follower 41 of the moving device 40 to the tool elements 80, 88 and for allowing the tool elements 80, 88 and the follower 41 to be moved in concert with each other and to be moved relative to the housing 10. The follower 41 further includes one or more apertures 43 formed therein, such as formed in the opposite side of the follower 41 that opposite to the peg 42. A knob 44 is slidably attached to the housing 10 for coupling to the follower 41 and for moving the follower 41 relative to the housing 10, and the knob 44 is extended out of the housing 10 for being suitably engaged with or frictionally depressed by the users.

Figure 2:
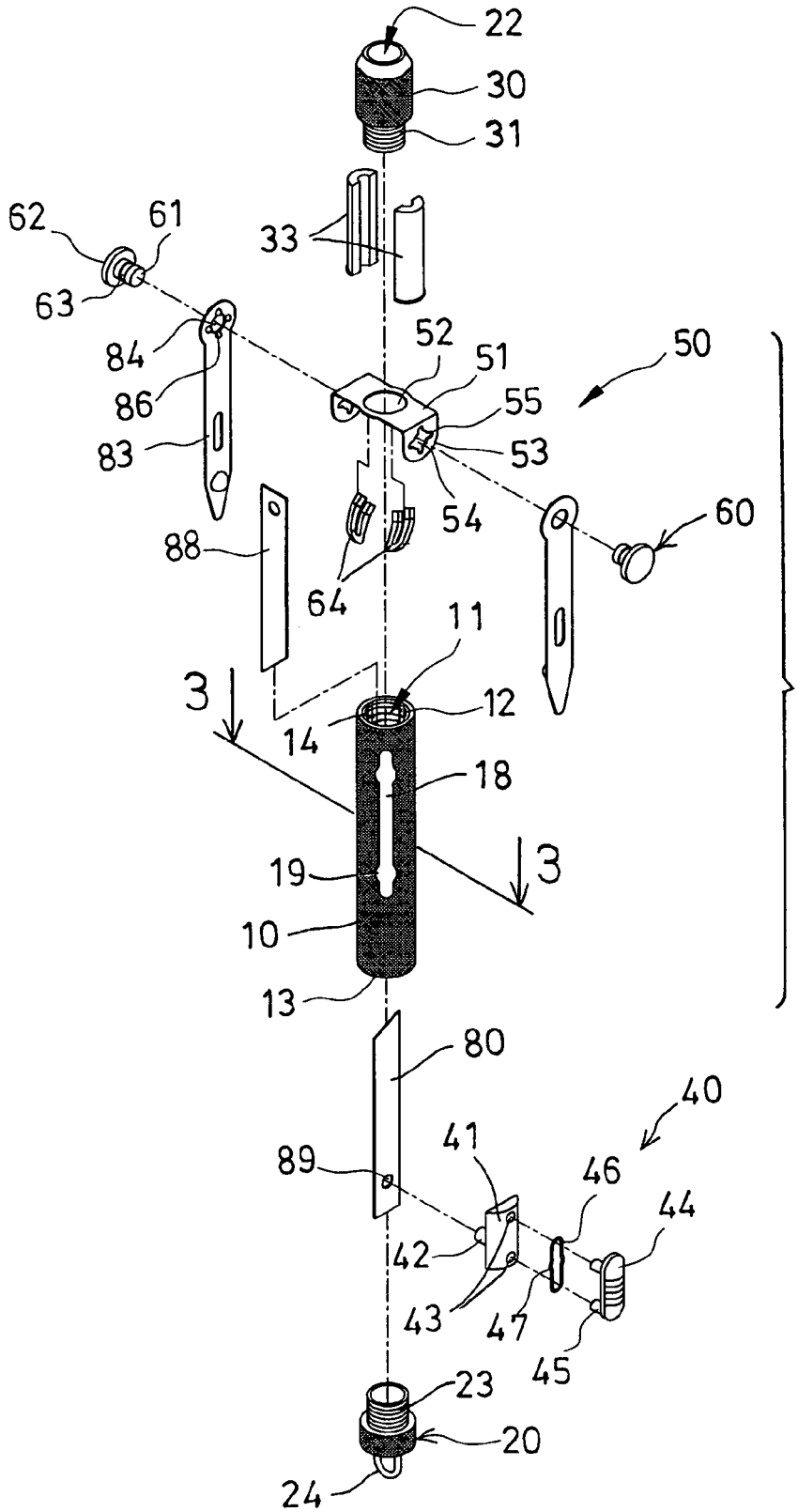
FIG. 2 is a partial exploded view of the tool device.

The knob 44 includes one or more, such as two pins 45 extended outwardly therefrom (FIG. 2) and slidably received or engaged in the groove 18 of the housing 10 for engaging into or with the apertures 43 of the follower 41 and for allowing the follower 41 and thus the tool elements 80, 88 to be moved relative to the housing 10 or to be moved into and out of the housing 10 with the knob 44. As also shown in FIG. 2, a spring ring or member 46 may be disposed or engaged between the follower 41 and the knob 44 and engaged around the pins 45, and includes one or more catches 47 extended outwardly therefrom for engaging into or with the notches 19 of the housing 10 and for positioning the follower 41 and the knob 44 and thus the tool elements 80, 88 at any selected or predetermined or suitable angular positions relative to the housing 10.

Figure 12:
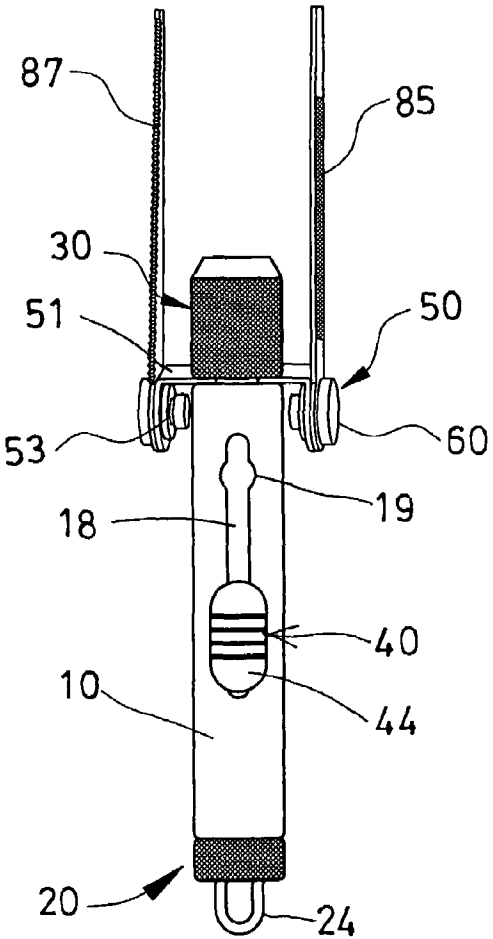
FIGS. 11, 12 are plan schematic views similar to FIGS. 1 and 7-8, illustrating the operation of the tool device.
Figure 11:
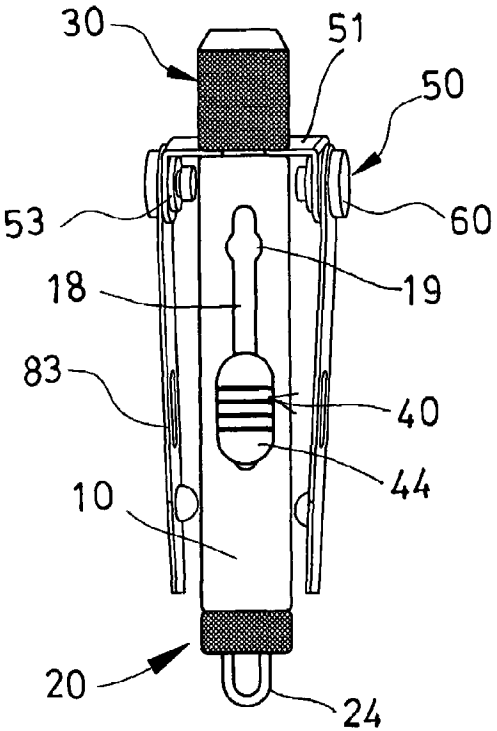
Figure 13:
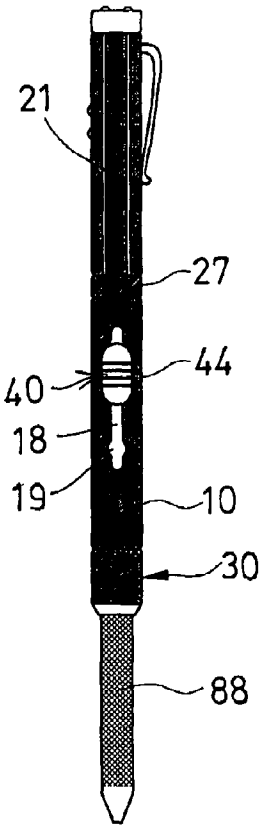
FIG. 13 is a plan schematic view similar to FIGS. 1, 7-8 and 11-12, illustrating the further arrangement of the tool device.

For example, the catches 47 of the spring member 46 or the spring biased means or catches 47 may be engaged with one of the notches 19 of the housing 10 for forming or acting as a positioning means or device and for positioning the tool elements 80, 88 at such as the selected or predetermined outwardly extended or working position relative to the housing 10 as shown in FIGS. 1, 5, 7-8 and 14-17, and may also be alternatively engaged with the other notch 19 of the housing 10 for positioning the tool elements 80, 88 at such as the selected or predetermined inwardly receiving position relative to the housing 10 as shown in FIGS. 4, 11-12. The knob 44 may be selectively disengaged from the follower 41, when required, for allowing the follower 41 and the tool elements 80, 88 to be selectively removed or disengaged from the housing 10 and to be replaced or repaired or changed with the other new tool elements 80, 88.

One or more additional tool assemblies 50 may further be provided and each include a bar 51 having an opening 52 formed therein for selectively receiving either of the shank 23, 31, 28 of the tool members 20, 21, 22 or the enclosing members 30 or the couplers 27 and for allowing the bars 51 of the additional tool assemblies 50 to be selectively and changeably attached or engaged between the housings 8, 10 and the enclosing members 30 (FIGS. 1, 4-5, 7-8, 11-12, 15, 17), or between the housings 8, 10 and the tool members 22 (FIG. 16), or the like, and thus for allowing the additional tool assemblies 50 to be optionally or selectively attached or engaged with the housings 8, 10, the enclosing members 30 and/or the tool members 22.

As shown in FIGS. 1-2 and 4-6, the bars 51 of the additional tool assemblies 50 each include two end flaps 53 extended therefrom, such as extended downwardly therefrom for selectively or changeably or detachably attaching the further tool elements 83, 85, 87, such as the clips 83 (FIGS. 1-2, 4-8, 11, and 15-17), the files 85 and/or the saw blades 87 (FIG. 12), or the like. The flaps 53 of the bars 51 each preferably include a cavity 54 formed therein, and one or more depressions 55 also formed therein and provided around the cavity 54 thereof and communicating with the cavity 54 thereof.

The tool elements 83, 85, 87 each also preferably include an orifice 84 formed therein for aligning with the cavities 54 of the flaps 53 of the bars 51 respectively and for receiving fastening means or devices 60 which may pivotally or rotatably secure or couple the tool elements 83, 85, 87 to the flaps 53 of the bars 51 respectively. The tool elements 83, 85, 87 each further include one or more projections 86 extended therefrom and provided or located around the orifice 84 thereof for selectively and changeably engaging into the depressions 55 of the flaps 53 of the bars 51 and for positioning the tool elements 83, 85, 87 at selected or predetermined positions relative to the flaps 53 of the bars 51 (FIGS. 11, 12).

Figure 6:
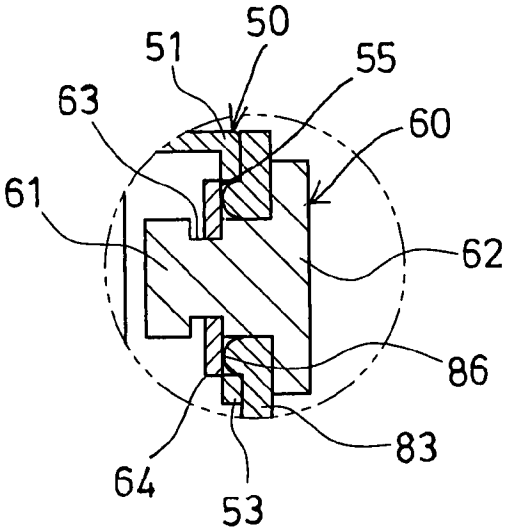
FIG. 6 is an enlarged partial cross sectional view of the tool device.
Figure 5:
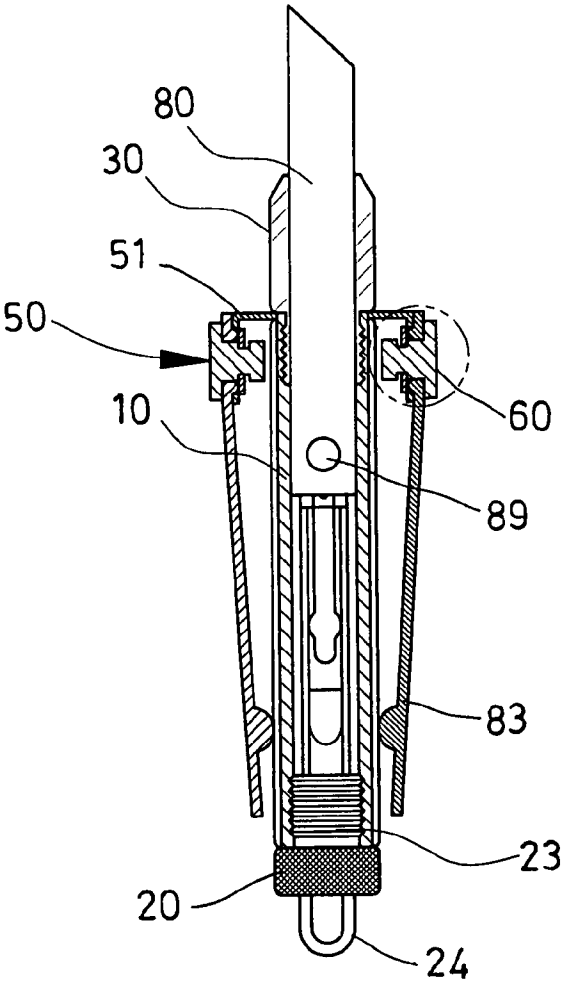
FIG. 5 is a partial cross sectional view similar to FIG. 4, illustrating the operation of the tool device.
Figure 10:
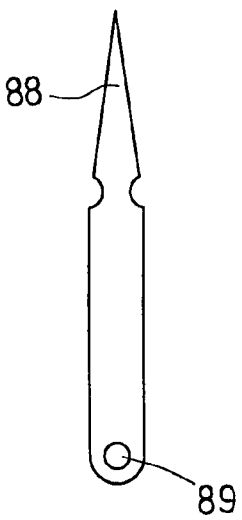
FIGS. 9, 10 are plan schematic views illustrating the other arrangements of the tool member of the tool device.

The fastening means or devices 60 each further include a stem 61 for engaging through the orifices 84 of the tool elements 83, 85, 87 and the cavities 54 of the flaps 53 of the bars 51 respectively and thus for pivotally or rotatably securing or coupling the tool elements 83, 85, 87 to the flaps 53 of the bars 51 respectively, and each include an enlarged head 62 formed or provided on one end of the stem 61 for engaging with the flaps 53 of the bars 51 or with the tool elements 83, 85, 87 and for anchoring or for positioning or retaining the stems 61 of the fastening devices 60 to the tool elements 83, 85, 87, and each include a peripheral slot 63 formed in the stem 61 for selectively receiving a retaining ring or member 64 (FIGS. 2, 6).

In operation, the retaining rings or members 64 may be engaged with the tool elements 83, 85, 87 or with the flaps 53 of the bars 51 for biasing or forcing the projections 86 of the tool elements 83, 85, 87 to engage into the depressions 55 of the flaps 53 of the bars 51, and thus for resiliently securing the tool elements 83, 85, 87 to the flaps 53 of the bars 51, and thus for allowing the tool elements 83 to act as the clips 83 and to clamp or attach or secure the tool device in accordance with the present invention onto various kinds of objects, such as the waist belts of the users, or the like.

Accordingly, the tool device in accordance with the present invention includes a number of tool members or tool elements selectively and changeably attached or coupled together for conducting various kinds of works.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool device comprising:

a housing including a chamber formed therein, and including two end portions, at least one tool member selectively attachable to either of said end portions of said housing, at least one enclosing member selectively attachable to either of said end portions of said housing, and including a bore formed therein, at least one tool element slidably received in said chamber of said housing and slidable or movable out through said bore of said at least one enclosing member, a moving device attached and coupled to said at least one tool element for moving said at least one tool element relative to said housing and for selectively moving said at least one tool element into and out of said bore of said at least one enclosing member, and an additional tool assembly selectively attachable to said housing and including a bar for attaching to said housing, said bar including two end flaps extended therefrom, and at least one second tool element attached to either of said flaps of said bar, said flaps each including a cavity formed therein, and said at least one second tool element including an orifice formed therein for aligning with said cavity of said flaps and for receiving a fastening device which pivotally couples said at least one second tool element to said flaps of said bar.

2. The tool device as claimed in claim 1, wherein said moving device includes a follower slidably received in said housing and coupled to said at least one tool element and moved in concert with said at least one tool element.

3. The tool device as claimed in claim 2, wherein said housing includes a space formed therein and communicating with said chamber of said housing for slidably receiving said follower.

4. The tool device as claimed in claim 3, wherein said moving device includes a knob coupled to said follower for moving said follower and said at least one tool element relative to said housing.

5. The tool device as claimed in claim 4, wherein said housing includes a groove formed therein and communicating with said space of said housing, and said knob includes at least one pin extended therefrom and slidably engaged in said groove of said housing for engaging with said follower and for allowing said follower and said at least one tool element to be moved relative to said housing with said knob.

6. The tool device as claimed in claim 4, wherein said moving device includes means for positioning said at least one tool element to said housing.

7. The tool device as claimed in claim 6, wherein said positioning means includes a spring biased catch attached to said knob and engaged with said housing for positioning said at least one tool element to said housing.

8. The tool device as claimed in claim 7, wherein said housing includes a groove formed therein and communicating with said space of said housing, and said knob includes at least one pin extended therefrom and slidably engaged in said groove of said housing for engaging with said follower and for allowing said follower and said at least one tool element to be moved relative to said housing with said knob, and said spring biased catch is engaged with said at least one pin of said knob.

9. The tool device as claimed in claim 8, wherein said housing includes at least one notch formed therein and communicating with said groove of said housing for engaging with said spring biased catch and for positioning said spring biased catch to said housing.

10. The tool device as claimed in claim 8, wherein said moving device includes a spring ring member engaged with said at least one pin of said knob and having said spring biased catch extended therefrom.

11. The tool device as claimed in claim 8, wherein said follower includes at least one aperture formed therein for receiving said at least one pin of said knob and for attaching said knob to said follower.

12. The tool device as claimed in claim 2, wherein said at least one tool element includes an orifice formed therein, and said follower includes a peg extended therefrom for engaging with said orifice of said at least one tool element and for attaching said follower to said at least one tool element.

13. The tool device as claimed in claim 1, wherein said housing includes a longitudinal channel formed therein and communicating with said chamber of said housing for slidably receiving said at least one tool element therein.

14. The tool device as claimed in claim 1, wherein said bar includes an opening formed therein, said at least one tool member and said at least one tool enclosing member each include a shank for engaging through said opening of said bar and for attaching said bar to said housing.

15. The tool device as claimed in claim 1, wherein said fastening device includes a stem engaged through said orifice of said at least one second tool element and said cavity of said flap for pivotally coupling said at least one second tool element to said flaps of said bar.

16. The tool device as claimed in claim 15, wherein said fastening device includes a peripheral slot formed in said stem for receiving a retaining ring member.

17. The tool device as claimed in claim 1, wherein said flaps each include at least one depression formed therein and communicating with said cavity thereof, and said at least one second tool element includes at least one projection extended therefrom for engaging into said at least one depression of said flap and for positioning said at least one second tool element at selected positions relative to said flaps of said bar.

* * * * *